United States Patent [19]

Torigai et al.

[11] 4,325,628

[45] Apr. 20, 1982

[54] CLEANING DEVICE FOR AN IMAGE FORMING APPARATUS

[75] Inventors: Akiyoshi Torigai, Machida; Teruo Morikawa, Sagamihara; Masaki Nakaoka, Tokyo; Shinji Murata, Tokyo; Yoshiaki Sone, Tokyo, all of Japan

[73] Assignee: Canon Kabushiki Kaisha, Tokyo, Japan

[21] Appl. No.: 97,867

[22] Filed: Nov. 27, 1979

[30] Foreign Application Priority Data

Nov. 30, 1978 [JP] Japan ..... 53-147215

[51] Int. Cl.[3] ..... G03G 21/00

[52] U.S. Cl. ..... 355/15; 15/256.51; 118/652

[58] Field of Search ..... 355/15, 3 DD; 15/1.5, 15/256.51, 256.52; 118/652; 430/125

[56] References Cited

U.S. PATENT DOCUMENTS

| | | | |
|---|---|---|---|
| 3,472,695 | 10/1969 | Käufer et al. | 15/256.52 X |
| 3,660,863 | 5/1972 | Gerbasi | 15/256.51 X |
| 4,181,425 | 1/1980 | Higawa et al. | 15/256.52 X |
| 4,252,433 | 2/1981 | Sullivan | 355/15 |

*Primary Examiner*—Richard L. Moses

*Attorney, Agent, or Firm*—Fitzpatrick, Cella, Harper & Scinto

[57] ABSTRACT

A cleaning device for an image forming apparatus, wherein a magnetic developer image formed on the surface of an endlessly moving image bearing member is transferred onto an image transfer member, which comprises: a cleaning device to remove the magnetic developer remaining on the surface of the image bearing member; a magnetic field forming source situated in the vicinity of the cleaning device to confine the magnetic developer; a magnetic developer absorbing device having a surface to lead the confined magnetic developer from the surface of the image bearing member to a position away from it; a separating and guiding device which separates the magnetic developer from the magnetic developer adsorbing device, and guides the same outside the confining magnetic field; and a developer conveying device which conveys the removed toner in the direction substantially orthogonal to the moving direction of the image bearing member at a position where the confining magnetic field does not extend substantially.

4 Claims, 6 Drawing Figures

CLEANING DEVICE FOR AN IMAGE FORMING APPARATUS

BACKGROUND OF THE INVENTION

1. Field of the Invention

This invention relates to a cleaning device, and, more particularly, it is concerned with a cleaning device which removes the magnetic developer remaining on the surface of an image bearing member after the magnetic developer image formed on the image bearing member has been transferred onto a recording medium.

2. Description of the Prior Art

There have already been known various types of cleaning devices for removing residual toner from the surface of a latent image bearing member such as a photosensitive member, etc. which is a medium for visualizing an electrostatic latent image: for example, a "web cleaning" device, in which the toner is wiped off by means of a member like unwoven cloth (vide: e.g. U.S. Pat. No. 3,099,856 to R. H. Eicoru et al.), and a "blade cleaning" device, in which the toner is scraped off by a blade member (vide: e.g. U.S. Pat. No. 3,552,850 to S. F. Royka et al.). The former was adopted at the early stage of development of electrophotographic apparatus. This device wipes off the residual toner and simultaneously adheres the same onto a web. While it has an advantage of less scattering of the toner particles, it has disadvantages in that the device becomes complicated in construction and large in size. In comparison with the former, the latter attempted to reduce the size and weight of the device as well as improve its maintenance capability, although it still has the disadvantage of prohibitive toner scattering in comparison with the former device, wherein the toner is perfectly adsorbed onto the web. A possible reason for this is considered as follows: (1) the toner which has been scraped off by a blade freely drops into the recovery section and scatters due to shock at the time of its dropping; (2) the cleaning blade made of a resilient material brings about the so-called "stick-slip" vibrations to cause the toner to scatter during its removal. Explaining this latter point in more detail, the cleaning blade is made of an elastic material such as, for example, urethane rubber, etc. in order to prevent its adherence to the irregular surface of the image carrying member as well as to prevent damage caused to the surface of the image carrying member. Because it is made of such elastic material, however, the blade is subjected to compression-deformation due to frictional force with the image carrying member. This compression force in the blade gradually increases, and a greater compression force than the frictional force is transitionally accumulated in it. The thus augmented compression force will soon be sufficient to counter the frictional force, and be dissipated, whereby the cleaning blade instantaneously stretches over the surface of the image carrying member. This behavior occurs periodically causing the cleaning blade to vibrate and the toner to scatter. Since it is difficult to perfectly eliminate the causes for the toner scattering, various attempts have been made to provide a construction to prevent the toner from scattering. For example, a system of preventing the toner scattering has been proposed, as disclosed in U.S. Pat. No. 3,634,077, wherein a developing agent removed by the cleaning blade is adsorbed onto a roller surface, to which a voltage has been applied from a power source. In this system, while effective adsorption of the scattering developer can be attained, it becomes inevitably necessary to provide the voltage source to apply voltage to the adsorbing roller, with the consequence that the cleaning device as a whole tends to be large in size.

Further, there has been proposed another system, as taught in U.S. Pat. No. 3,742,551, wherein an elastic roller is provided beneath the cleaning blade, and, while causing it to contact lightly onto the surface of the photosensitive drum to follow its rotation, the dropping and scattering of the toner is prevented. While this system can also attain the effect of preventing scattering of the removed developing agent, it has the disadvantage that, owing to direct contact of the elastic roller surface to the photosensitive drum surface, the surface of a latter is stained, as the result the image forming effect is appreciably lowered in the course of its use over a long period of time.

Incidentally, the developing agent to be used for the electrophotographic reproduction apparatus has recently been changed from the two-component system toner consisting of a toner and a carrier to a single-component toner (magnetic developing agent) consisting of a magnetic material as a nucleus and a coloring substance covering the outer surface of the nucleus. The characteristic feature of this single-component toner resides in that the density of the developer is constant, hence there is no necessity for density adjustment. As a result of this, the electrophotographic reproduction apparatus can be made simple in construction. However, even when this single component system toner is used, the toner scattering would inevitably occur at the time of removing the residual toner, as already mentioned in the foregoing.

Furthermore, the electrophotographic reproduction apparatuses which have been manufactured recently are required to be of a resources-saving and non-polluting type. In order to meet such requirement, the apparatuses should be of such a design that, for example, (1) the removed toner may be transferred to the developing device for re-use, and (2) the toner is collected into a toner recovery box, which will then be discarded.

SUMMARY OF THE INVENTION

It is therefore a primary object of the present invention to provide a cleaning device which is capable of exhibiting a favorable cleaning effect.

It is another object of the present invention to provide a cleaning device which is compact in shape and efficient in operations.

It is still another object of the present invention to provide a cleaning device capable of efficiently recovering removed developer for re-use of the same in subsequent operations.

According to the present invention, generally speaking, there is provided a cleaning device for an image forming apparatus, wherein a magnetic developer image formed on the surface of an endlessly moving image bearing member is transferred onto an image transfer member, which comprises: a cleaning device to remove the magnetic developer remaining on the surface of the image bearing member; a magnetic field forming source situated in the vicinity of the cleaning device to confine the magnetic developer; means for adsorbing the magnetic developer having a surface to lead the confined magnetic developer from the surface of the image bearing member to a position away from it; separating and guiding means which separates the magnetic developer from the magnetic developer adsorbing means, and guides the same outside the confining magnetic field, and means for conveying the developer as removed in the direction substantially orthogonal to the moving direction of the image bearing member at a position where the confining magnetic field does not extend substantially.

BRIEF DESCRIPTION OF THE DRAWING

FIGS. 3A, 3B and 3C illustrate an arrangement of the adsorbing magnetic poles in the magnetic developer adsorbing means, wherein FIG. 3A is a side elevational view of the adsorbing magnets, FIG. 3B is a perspective view when the magnetic poles are arranged in parallel with the axis; and FIG. 3C is also a perspective view when the magnetic poles are arranged in a spiral form.

DETAILED DESCRIPTION OF PREFERRED EMBODIMENT

Figure 1:
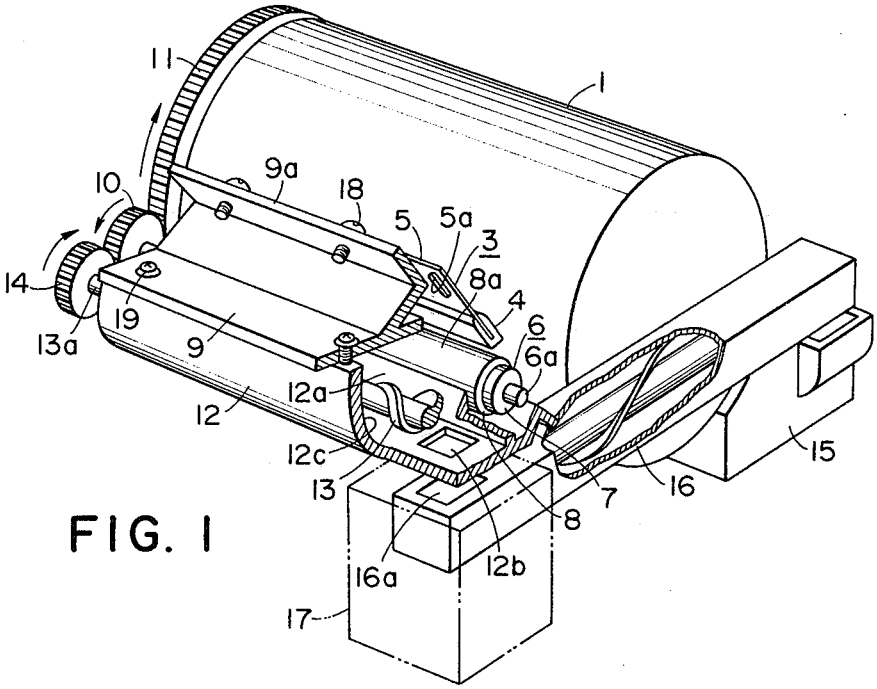
FIG. 1 is a perspective view of a preferred embodiment of the cleaning device according to the present invention with one part being cut away.
Figure 2:
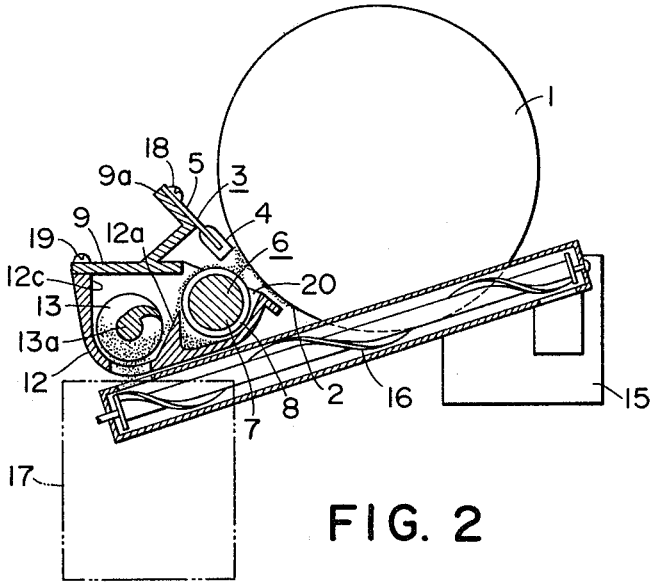
FIG. 2 is a side elevational view, partly in cross-section, of the same cleaning device shown in FIG. 1.

Referring to FIGS. 1 and 2, a reference numeral 1 designates a photosensitive member which is an image bearing member, and a numeral 3 refers to a blade for removing residual toner 2 from the photosensitive member 1. The blade 3 is constructed with a resilient blade section 4 having a blade edge to scrape off the toner in contact with the surface of the photosensitive member, and a core plate 5 having elastic property. One end of the core plate 5 has the blade section 4 mounted thereon and the other end of the plate is fixed to an inclined section 9*a* of a cover member 9 by means of screws 18. The core plate 5 serves to restrict vibrations due to stick-slip of the blade edge to the minimum possible extent. Passage holes 5*a* for the screws 18 are formed in a slot to enable adjustment of the contact pressure of the blade 3 to the photosensitive member 1. A reference numeral 6 designates a magnetic roll which is supported substantially horizontally on a shaft 6*a* within a casing 12 and in a freely rotatable manner. A peripheral part of the magnetic roll 6 projects from an opening 20 of the casing 12, and is situated in close proximity to the photosensitive member 1 below the blade 3. The magnetic roll 6 consists of a steel core 7 and a plastic magnet 8 (e.g. an "MP" magnet, a product of Mitsubishi Seiko K.K., Japan) adhered around the outer periphery of the core 7. In this structure, the magnetization is so made that the magnetic poles may be formed in parallel with the shaft as shown with chain lines 8*a*.

A gear 10 is fixedly secured on one end of the shaft 6*a* of the magnetic roll 6, and is meshed with a gear 11 integrally formed at one end of the photosensitive drum 1 around the outer periphery thereof. In the interior of the casing 12, there is formed a blade-shaped scraper 12*a* to scrape off the toner adhered onto the surface of the magnetic roll 6, the blade edge of which extends in the axial direction of the magnet roll 6. The illustrated embodiment forms the scraper 12*a* integral with the casing 12, although it may be feasible that a separate member such as a leaf spring is mounted in the interior of the casing to construct the scraper. It is particularly preferable that the scraper be made of a non-magnetic material. A reference numeral 13 designates a screw-conveyor which is supported on a shaft 13*a* within the casing 12 in a freely rotatable manner, and forms a conveying path for the toner removed from the magnetic roll 6. The screw-conveyor 13 is disposed in confrontation to the magnetic roll 6 with the scraper 12*a* being interposed therebetween. A gear 14 is fixedly secured at one end of the shaft 13*a*, and meshed with the gear 10. A reference numeral 12*b* designates a toner discharge port formed in the bottom surface of the casing to discharge the toner transferred by the screw-conveyor 13. Below this discharge port 12*b*, there is disposed a toner conveying means which carries the toner to a developing device 15 in case the toner is to be used again, or a recovery box 17 in case the toner is not re-used.

In order to secure removal of the toner from the magnetic roll 6, it is preferable that the edge of the scraper 12*a* be disposed at a level lower than the axis of the magnet roll shaft 6*a*. Further, the directions of rotation and twisting of the screw-conveyor 13 are respectively made the right turn and right twisting, in the illustrated embodiment, so that the toner 2 may be brought to the opposite side surface 12*c* of the scraper 12*a*, whereby the removed toner does not stay at the back surface of the scraper 12*a*, and is transferred in the direction of the magnetic roll shaft along the conveying path to secure the toner removal from the magnetic roll 6.

Scattering of the toner particles can be prevented in the following manner, even when they float up. That is, on the surface of the photosensitive member 1 which rotates in the arrowed direction, there remains the toner 2 which has been left unused after the image transfer onto paper. This toner 2 is scraped off the surface of the photosensitive member 1 by the cleaning blade 3, the most part of which drops of its own gravity, and the remainder of which scatters and floats in the space due to vibration of the blade. This floating toner, however, is captured by magnetic force of the magnetic roll 6 to be adsorbed onto the roll surface. Of the toner particles which have dropped of their own gravity, those toner particles which are likely to float by the shock of their droppage are subject to control by the magnetic force of the magnetic roll 6, and their scattering is prevented. The toner particles which have been adhered to the magnetic roll 6 are scraped off by the blade edge of the scraper 12*a*, dropped on the screw-conveyor 13, and are transferred toward the discharge port 12*b*.

Figure 3A:
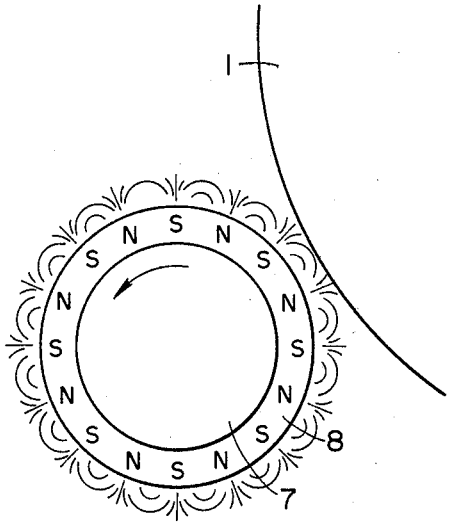
Figure 3B:
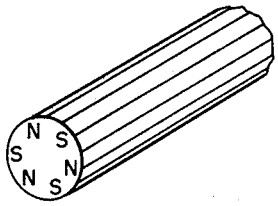
Figure 3C:
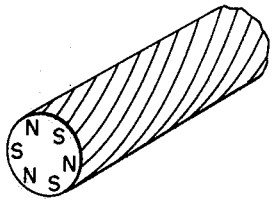

FIGS. 3A, 3B and 3C illustrate the example of the magnetic pole arrangement on the magnetic roll, in which N and S poles are alternately disposed around the periphery of the roll. While it goes without saying that the magnetizing force should be sufficient to confine the dropping toner particles, the alternate arrangement of the N and S poles with an appropriate pitch between them makes it possible to confine the influence of the magnetic field within an area sufficient to capture the dropping toner particles in the vicinity of the magnetic roll surface. In this way, there is no apprehension at all that the movement of the recovered toner, discharged under the influence of the magnetic field of the magnet roll, will be restricted at the time of its discharge outside the device by means of the screw-conveyor. Therefore, the recovered toner can be favorably discharged by the screw-conveyor. For example, if it is assumed that the magnet roll is magnetized with a magnetic force of 400 gausses and above, and the magnetic poles are arranged along the circumferential direction of the magnet roll with a pitch therebetween of 4 mm or less, good results can be obtained. Also, besides the magnetic poles being disposed linearly in the axis direction of the magnetic roll as shown in FIG. 3B, they may be effectively disposed in a spiral form as shown in FIG. 3C. In this instance, if a space interval between the magnetic roll and the screw-conveyor is maintained at 3 mm and above, the screw-conveyor is able to perform favorable conveyance of the removed toner without being effected by the magnetic roll.

The preventive effect of the scattering toner, in case the cleaning operation is done with a urethane rubber blade (hardness: 70 to 80 degrees) having a thickness of 3 mm and a width of 30 cm and under a pressure of 1 kg., is extremely favorable when the magnetic roll is spaced for 5 mm or less with respect to the contact position of the blade. Moreover, by spacing the image bearing member from the magnetic roll at less than 1 mm, toner leaking outside the cleaning device can be perfectly prevented.

Figure 4:
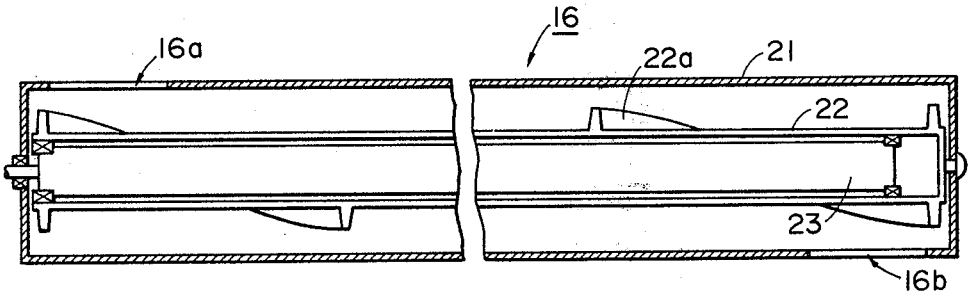
FIG. 4 is a longitudinal cross-sectional view of a conveying device to convey the recovered developer to the developing means.

FIG. 4 shows a longitudinal cross-sectional view showing the toner conveyor means which conveys the toner from the cleaning device to the developing device. In the drawing, the toner conveying means 16 has a non-magnetic cylindrical body 22 fixedly provided within the casing 21, inside which the magnetic roll 23 is further provided in a freely rotatable manner. Also, around the surface of the non-magnetic cylindrical member 22, there are provided non-magnetic screw blades 22*a*. Onto one end surface of the non-magnetic cylindrical member 22 of the above-mentioned construction, the toner which has dropped through the opening 16*a* of the casing 21 is adsorbed. The thus adsorbed toner particles move along the periphery of the magnetic roll 23 following its rotation. In the course of movement, the toner particles contact the screw blades 22*a* to be further moved in the axial direction to the other end of the non-magnetic cylindrical member 22, where the toner particles which have been conveyed are dropped through an opening 16*b* formed in the bottom of the casing at this other end. In the vicinity of this dropping position, the magnetic influence is removed so as to facilitate dropping of the toner particles. Because of this, the length of the magnetic roll can be shortened effectively.

In particular, since the magnetic developer is transferred under confinement of the magnetic field, as in the above-mentioned construction, any impurities which will possibly be mixed at the time of cleaning, such as constituent fibers of the image transfer paper, etc., can be entirely separated and removed during its conveyance, which is very favorable. In addition, this manner of conveyance makes it possible to transfer the toner particles in the upward direction against the gravity, so that, even when the cleaning device is positioned below the developing device as shown in the drawing, the removed developing agent can be re-used effectively.

In the foregoing, a preferred embodiment of the present invention has been described. Besides this embodiment, it is possible to form the magnetic roll, as the toner adsorbing means, in the form of a non-magnetic cylindrical member which incorporates therein a magnet and is capable of moving relative to the magnet. In this case, a projection having a function of the above-mentioned scraper is provided on one part of the peripheral surface of the cylindrical body in its axial direction so that the toner particles which have moved along the peripheral surface of the cylindrical member by rotation of the magnet may be separated from the peripheral surface of the cylindrical member by the above-mentioned projection.

Further, this cleaning device is not limited to the electrophotographic device alone, but it can also be applied as the cleaning device for a residual magnetic developing agent in a magnetic image forming device which visualizes a latent image by the use of the magnetic developing agent.

Since the present invention provides an expedient which magnetically adsorbs and captures the toner particles which scatter or tend to scatter at the time of removing the residual toner from the image bearing surface, taking advantage of the fact that the toner for the image forming apparatus using the magnetic developing agent is magnetic in property, as mentioned above, and incorporates such expedient in any type of image forming apparatus, the image bearing member can be cleaned without scattering the toner particles. In this way, it becomes possible to transfer without failure the developing agent which has been adsorbed on the magnetic adsorbing means through the conveying path, and in the axial direction of the magnetic adsorbing means for re-use or recovery. Therefore, the cleaning device according to the present invention also meets the resource-saving purpose.

What we claim:

1. A cleaning device for an image forming apparatus, wherein a magnetic developer image formed on the surface of an image bearing member is transferred onto an image transfer material, said device comprising:

cleaning means to remove the magnetic developer remaining on the surface of the image bearing member after transfer;

magnetic field generating means disposed in the vicinity of said cleaning means for trapping the magnetic developer removed from the image bearing member by said cleaning means, said magnetic field generating means including a magnetic roll for conveying said trapped developer, said roll having magnetic poles disposed therearound, and wherein said magnetic poles around said magnetic roll are disposed in a spiral form with respect to the axis of said magnetic roll.

2. A cleaning device for an image forming apparatus, wherein a magnetic developer image formed on the surface of an image bearing member is transferred onto an image transfer material, said device comprising:

cleaning means to remove the magnetic developer remaining on the surface of the image bearing member after transfer;

transfer means for conveying the developer removed by said cleaning means to a removed developer collecting zone, wherein said developer transfer means comprises a non-magnetic screw and a magnetic roll in the interior of said screw.

3. The cleaning device as set forth in claim 2, wherein said developer transfer means upwardly conveys the developer which has been applied thereto by said cleaning means.

4. The cleaning device as set forth in claims 1 or 2, wherein said cleaning means is an elastic cleaning device.

* * * * *